US006779527B2

(12) United States Patent
Ehling et al.

(10) Patent No.: US 6,779,527 B2
(45) Date of Patent: Aug. 24, 2004

(54) DEVICE FOR CONDITIONING COMMINUTED TOBACCO MATERIAL

(75) Inventors: Uwe Werner Ehling, Goldkronach (DE); Frank Plückhahn, Bayreuth (DE); Gerald Schmekel, Elmshorn (DE); Arno Weiss, Nordersted (DE)

(73) Assignee: British American Tobacco (Germany) GmbH, Hamburg (DE)

( * ) Notice: Subject to any disclaimer, the term of this patent is extended or adjusted under 35 U.S.C. 154(b) by 62 days.

(21) Appl. No.: 09/921,351

(22) Filed: Aug. 2, 2001

(65) Prior Publication Data

US 2002/0033182 A1 Mar. 21, 2002

(30) Foreign Application Priority Data

Aug. 4, 2000 (DE) ..... 100 38 114

(51) Int. Cl.[7] ..... A24B 1/02

(52) U.S. Cl. ..... 131/304; 131/291; 131/300; 131/296; 131/306

(58) Field of Search ..... 131/291, 300, 131/302, 304, 296, 900, 301, 306; 99/323.4, 323.9, 323.8; 426/445, 447

(56) References Cited

U.S. PATENT DOCUMENTS

| | | | | |
|---|---|---|---|---|
| 4,253,474 A | * | 3/1981 | Hibbitts et al. | 131/140 P |
| 4,561,453 A | * | 12/1985 | Rothchild | 131/304 |
| 4,791,942 A | * | 12/1988 | Rickett et al. | 131/291 |
| 5,740,817 A | | 4/1998 | Cunningham | |
| 6,158,441 A | | 12/2000 | Grigutsch et al. | |
| 6,221,413 B1 | * | 4/2001 | Bichsel | 426/281 |

FOREIGN PATENT DOCUMENTS

| | | |
|---|---|---|
| DE | 197 34 364 | 2/1999 |
| WO | WO 87/07478 | 12/1987 |
| WO | WO90/06695 | 6/1990 |
| WO | WO 95/01108 | 1/1995 |
| WO | WO99/23898 | 5/1999 |

* cited by examiner

*Primary Examiner*—Dionne A. Walls
(74) *Attorney, Agent, or Firm*—John F. Salazar; James E. Cole; Middleton Reutlinger

(57) ABSTRACT

The invention relates to a method and a device for conditioning comminuted tobacco material by heating and moistening with water vapor, wherein the comminuted tobacco material free-falls down through a chamber operating in a continuous process and is treated during free-fall with water vapor via nozzles; a hyperbaric pressure is maintained in said chamber.

19 Claims, 3 Drawing Sheets

DEVICE FOR CONDITIONING COMMINUTED TOBACCO MATERIAL

This utility patent application claims priority to German Patent Application No. 100 38 114.6, filed Aug. 4, 2000.

BACKGROUND OF THE INVENTION

1. Field of the Invention

The present invention relates to a method and a device for conditioning comminuted tobacco material by heating and moistening with water vapor.

The term "comminuted tobacco material" is here to be understood, for example, as threshed tobacco leaf, tobacco stems, tobacco stalks, each of these cut or comminuted, recycled tobacco as well as tobacco by-products such as tobacco primary winnowings and tobacco secondary winnowings.

Such methods are mainly used for pre-conditioning comminuted tobacco material, as the first stage of an expansion method, in order to increase the so-called "filling capacity" of the tobacco material.

Freshly harvested, green tobacco leaves contain relatively high proportions of water, which is reduced to a residual water content of less than 10% by means of various methods described as "curing methods". The raw tobacco prepared in this way is taken to factories for the manufacture of, for example, cigarettes or other luxury food.

The processing chain from greenleaf to raw tobacco, however, causes a considerable shrinkage of the tobacco material, and this reduction in volume has a disadvantageous effect on the filling capacity.

Various methods have therefore been developed to at least partly reverse this reduction in volume, exploiting the fact that the cell framework of comminuted tobacco material can comprise the volume originally found in the leaf.

Amongst known expansion processes, two groups of cases are distinguished, namely: the High Order Process, wherein the tobacco is loaded into an autoclave with a slightly volatile propellant, such as for example carbon dioxide or nitrogen, whereby increases in the filling capacity in the range of 100%, compared with the measuring value after cutting, may be achieved if the method is suitably carried out; or the Low Order Process, wherein the pre-conditioning with water vapor is followed by drying, for example in an flow dryer, a fluid or vortex dryer or a drum dryer. Drying is followed by so-called post-conditioning, comprising re-moistening, sieving and cooling. Using low order processes, the filling capacity may be increased by up to 50%.

The present invention concerns a low order expansion process, wherein the tobacco material is pre-conditioned by being pre-heated/pre-moistened with water vapor and then dried.

2. Review of the Prior Art

Various low order expansion processes are already known. DE 37 10 677 C2 shows an expansion device comprising a cellular wheel sluice for feeding the tobacco material to an expansion chamber formed by a sub-domain of the cellular wheel sluice. A hot gas consisting of air and water vapor is introduced into the expansion chamber, such that the tobacco material is accelerated by a pressure drop to at least 50 m/s, the tobacco material remaining in the expansion chamber less than 0.1 s.

WO 99/23898 describes a device for saucing and moistening tobacco. Tobacco is introduced into the device by an airlock, in such a way that no air can enter the device. The tobacco falls downward through the device and is sprayed with vapor/water/casing and other materials by side nozzles. The pressure of the nozzles is in the range 0.1 to 10 bars. The treatment takes place at atmospheric pressure, since no lock to the treatment area is provided on the discharge side.

WO 97/04673 discloses a method for expanding tobacco stems, pressurized in a locked container by means of saturated vapor, until all the cells of the stems are moistened. Then the pressure is quickly reduced, whereby the cells "explode". Due to its discontinuous batch-wise function this system is not economically optimal.

Finally, a method and device of the cited type follow from DE 197 34 364 A, wherein comminuted tobacco material is introduced into a chamber via a cellular wheel sluice. In this chamber, the tobacco material free-falls downward, radially through a rotating jet curtain of the conditioning medium. In addition, a conveying means, specifically a Winnover cylinder, is arranged inside the chamber, rotating about an axis running substantially perpendicular to the flow direction of the tobacco, and comprises substantially radially extending nozzles openings for the conditioning medium.

Said Winnover cylinder also serves to disperse the tobacco consisting of more or less clumped together strands.

An additional cellular wheel sluice may be provided on the discharge side (see FIG. 4), transporting the tobacco to an oscillating conveyor to be transported on to a drying means.

A disadvantage of this type of pre-conditioning is the mechanical demands on the tobacco in order to disperse the clumps, which are caused by the fats which melt on the surface of the tobacco particles during heating and moistening.

SUMMARY OF THE INVENTION

It is the underlying object of the invention to provide a method and a device for (pre-) conditioning comminuted tobacco particles, wherein the aforementioned disadvantages do not arise. In particular, a method and a device are to be suggested which make no mechanical demands on the delicate tobacco particles while retaining the advantages of a continuous operation method.

The present invention proposes a method for condition comminuted tobacco material by heating and moistening with water vapor, wherein:

a) said comminuted tobacco material free-falls down through a chamber operating in a continuous process; and
b) is treated during said free-fall with water vapor via nozzles, wherein a hyperbaric pressure is maintained in said chamber.

Furthermore, the present invention proposes a device for conditioning comminuted tobacco material by heating and moistening with water vapor, comprising:

a) a chamber in which said comminuted tobacco material free-falls downwards;
b) a cellular wheel sluice at each of the upper inlet and the lower outlet of said chamber; and
c) nozzles for treating said free-falling, comminuted tobacco material with water vapor;

wherein:

d) both cellular wheel sluices are formed as pressure differential proof sluices, such that a hyperbaric pressure of more than 1 bar is maintained in said chamber.

Suitable embodiments are defined by the accompanying sub-claims.

The advantages achieved by the invention are based on the following considerations: an increase in the filling capacity, measured in comparison with the filling capacity value after the tobacco has been cut, can be affected by increasing the moistness with which the pre-conditioned tobacco enters the dryer, the so-called dryer entry moistness. At given dryer parameters, in particular given dryer geometry, and here again fixed dryer length, the filling capacity rises when the dryer entry moistness is increased.

Moreover, increasing the temperature of the tobacco at entry into the dryer has a positive effect on the filling capacity, as this leads to a fast exchange of energy/heat and material between the gas phase in the dryer and the tobacco particles, which is in turn highly important for successful drying with respect to the filling capacity.

The invention achieves this additional improvement in the exchange of energy/heat and material through (pre-) conditioning under pressure, i.e. conditioning at an absolute pressure of more than 1 bar. In addition, the flow of tobacco, continuously falling downward, is treated with vapor in a chamber which is formed to be pressure differential proof, in such a way that a temperature and a pressure are set in the chamber in accordance with the vapor pressure line of the saturated vapor.

It is also possible in this respect to feed superheated vapor into the chamber and thus to achieve temperatures in the chamber above the corresponding equilibrium pressure.

With such pre-treatment, tobacco may be pre-heated to 180° C., if a pressure of 10 bars absolute is maintained in the interior of the chamber. Pre-heating is here combined with simultaneous moistening. Since this process is initiated by condensing, temperature and moistness are quickly set to equilibrium conditions.

The tobacco, pre-conditioned under pressure, is taken directly, without intermediate storage, from the pre-conditioning chamber into the hot air stream of the dryer, forcing the tobacco to assume the corresponding equilibrium temperature of the water, in dependence on the pressure and temperature prevailing in the dryer. This means that by exploiting the thermal energy stored in the tobacco, vaporization takes place with cooling down to the so-called cooling limit temperature, which at ambient pressure lies between about 40° C. and 98° C., depending on the vapor content and the temperature of the atmosphere in the dryer. If a dryer is used at higher pressures, higher cooling boundary or limit temperatures may also be achieved.

It is thus possible to devise vaporization processes based on the presence of thermodynamic imbalances, without convectional exchange of heat, i.e. the exchange of energy between the drying gas and the tobacco particles in systems with forced movement.

This type of demoistening in the dryer is distinguished by its extremely high vaporization rates, and results in an additional gain in filling capacity as compared with conditioning in open, atmospheric systems, such as e.g. a drum or steam tunnel.

In a preferred embodiment, the water vapor is fed into the chamber through ring nozzles arranged flush with the inner surface area of the chamber, to rule out catching edges which could impede the passing of the tobacco.

Although the discharge direction of the nozzles may in principle be directed horizontal or even upwards, against the flow of tobacco, the discharge direction of the nozzle in accordance with a preferred embodiment is inclined downwards, to assist the conveying/flight movement of the tobacco, thus accelerating free-fall and ultimately increasing the rate of the method.

The vapor may be fed into the chamber at any desired angle, even for instance tangentially. However, it preferably runs at an angle of 90° to the circumferential direction of the chamber wall, in order to achieve as high an impact effect as possible.

To avoid water vapor condensing on the inside wall of the pressure container, the container should be provided with a heating jacket, into which vapor of a slightly higher temperature than the vapor temperature of the (ring) nozzle vapor temperature is likewise fed.

The chamber should expand downwardly in a sort of tapered manner, since any risk of an occlusion can then be ruled out as far as possible.

Care should be taken that the tobacco falls through the chamber without building up, since build up—otherwise often used to generate a resting time—is not necessary in this type of processing, because the equilibrium temperature is set very quickly by the condensation.

In order to avoid any unwanted build-up of tobacco in the pressurized chamber, the discharge sluice should be run at a slightly higher conveying volume than the feed sluice. This may be achieved, for example, via the speed of the sluice and/or a greater chamber volume for the sluice chamber.

Once it has passed through the pressurized chamber, the pre-heated and moistened, i.e. pre-conditioned, tobacco is fed into a dryer, for which known conventional dryers, such as for example drum dryers or fluid bed dryers, may be used. The filling capacity is not, however, raised by the more slowly proceeding drying in these variants to the same extent as when an airflow dryer is used, which is thus preferred.

The pre-conditioned tobacco discharging from the lower cellular wheel sluice is thus swept along by the hot gas stream of said airflow dryer, and dried to its desired discharge moistness by its resting time in this dryer section.

Said drying of the tobacco is characterized in the first stage by the quick vaporization, up until the cooling limit or boundary temperature is reached; in this way, the vaporization energy is exclusively provided by the tobacco particles themselves.

In the second section, by contrast, the tobacco is dried by convectional exchange of material and heat. This second drying process is slower than vaporization, and thus contributes proportionally less to increasing the filling capacity.

Even if the less favorable embodiments of dryers, namely drum dryers or fluid bed dryers, are used, higher filling capacities are achieved by the vaporization and drying processes described above than by the conventional combination of a pre-heating drum/steam tunnel with a drum/fluid bed dryer.

As already indicated above, the use of a cellular wheel sluice which is "pressure differential proof" is important, that is to say a cellular wheel sluice which, despite unavoidable leakage due to sealing problems on the one hand, and vapor leaking out via the individual chambers of the cellular wheel sluice on the other hand, maintains a largely constant absolute pressure in the chamber interior, and therefore a constant pressure differential between the atmospheric pressure outside the chamber and the interior pressure of the chamber. Suitable cellular wheel sluices which are pressure differential proof are available on the market.

BRIEF DESCRIPTION OF THE DRAWINGS

The invention will now be explained by way of example embodiments and by referring to the schematic drawings enclosed, in which.

DETAILED DESCRIPTION OF THE PREFERRED EMBODIMENT

Figures 1, 2:
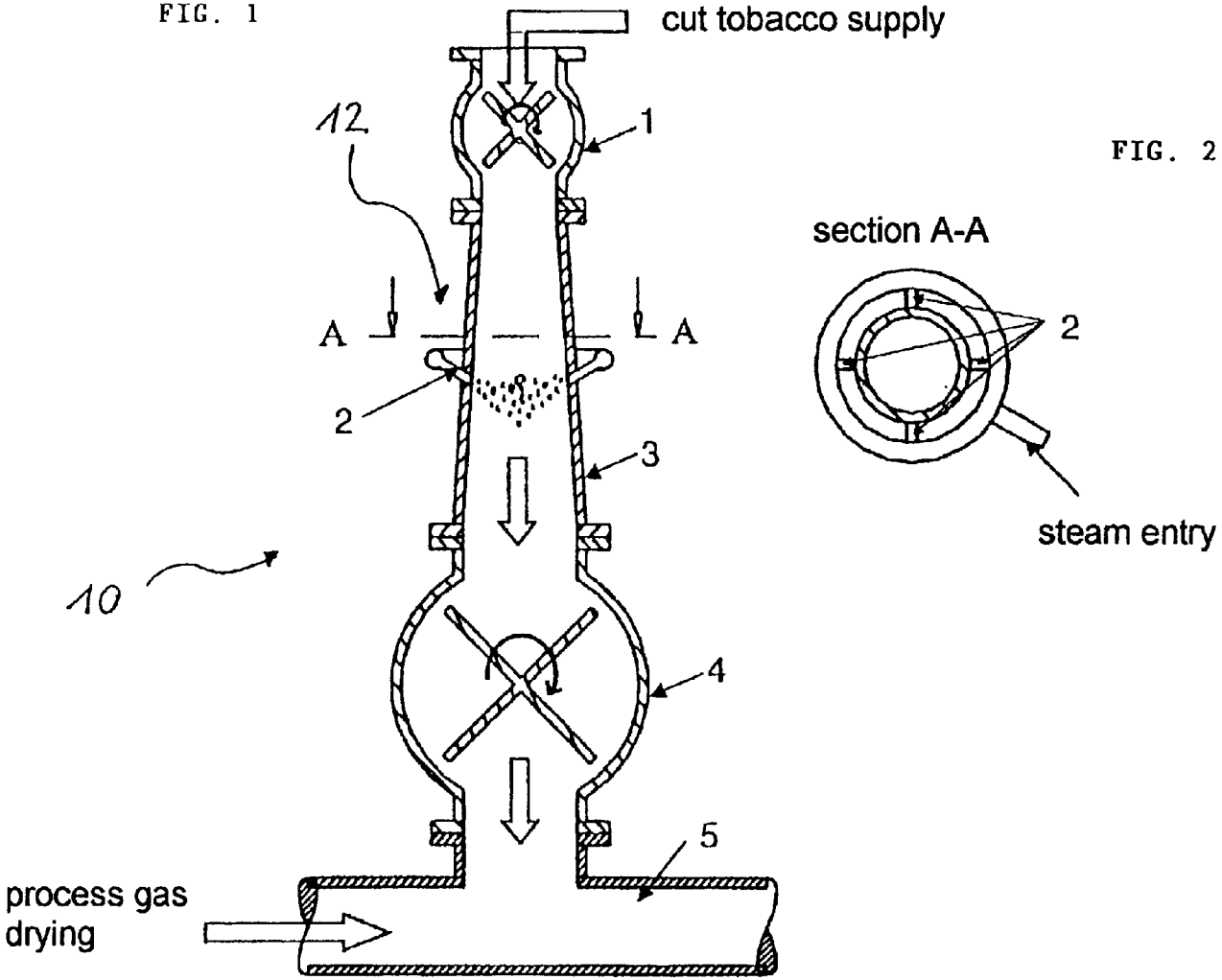
FIG. 1 is a vertical cross-section through a first embodiment of a device for (pre-) conditioning comminuted tobacco material.
FIG. 2 is a cross-section along the line A—A in FIG. 1.

FIG. 1 shows an expansion device, broadly indicated by the reference numeral 10, comprising a device for pre-conditioning comminuted tobacco material and an airflow dryer connected thereto, which is arranged beneath the pre-conditioning device 12.

Cut tobacco particles (lamina) are fed into the substantially vertically arranged pre-conditioning device 12 via suitable conveyors, for example oscillating conveyor channels, and fed into the pressure proof chamber 3 of the device 12 via an upper, pressure differential proof, cellular wheel sluice 1, the tobacco particles free-falling in said chamber. Vertically, the chamber 3 expands conically downwardly in order to rule out a banking or jamming of tobacco particles.

About half way down the chamber 3, ring nozzles 2 (see also FIG. 2) are arranged flush with the inner surface area of the chamber 3, in order to rule out catching edges which could impede the passing of the tobacco.

In the embodiment shown, the discharge direction of the ring nozzles 2 is inclined downwards, to assist the conveying/flight movement of the tobacco. The discharge direction of the ring nozzles 2 may in principle, however, be directed horizontal or even upwards, against the flow of tobacco.

The tobacco particles free-fall downwards in the tapered chamber 3, and are introduced directly into the horizontal section of an airflow dryer 5 via a lower, similarly pressure differential proof, cellular wheel sluice 4.

As an alternative to the embodiment shown, a vertical flow drying section may also be used.

In order to avoid build-up or jamming of tobacco in the chamber 3, the lower cellular wheel sluice 4, serving as a discharge sluice, is run at a slightly higher conveying volume than the upper feed sluice 1; this may be achieved, for example, via the speed of the sluices and/or a greater volume of the individual sluice chambers, as is evident from FIG. 1.

As may be recognized in FIG. 2, vapor is introduced into a ring chamber in the wall of the chamber 3, from which the ring nozzles 2, which are radially directed downwards into the interior of the chamber, are fed.

Even before tobacco particles begin to be fed to the chamber, the interior of the chamber 3 is placed under an absolutely measured pressure, by feeding saturated vapor in through the ring nozzles 2. In this way, a pressure is built up in the interior of the chamber 3 which is dependent only on the temperature of the saturated vapor being fed in.

Due to the two pressure differential proof, cellular wheel sluices 1, 4, this pressure is maintained during continuous running operation, such that extremely high dryer entry temperatures and moistness of the tobacco may be achieved, as compared with conventional methods.

Figures 3, 4:
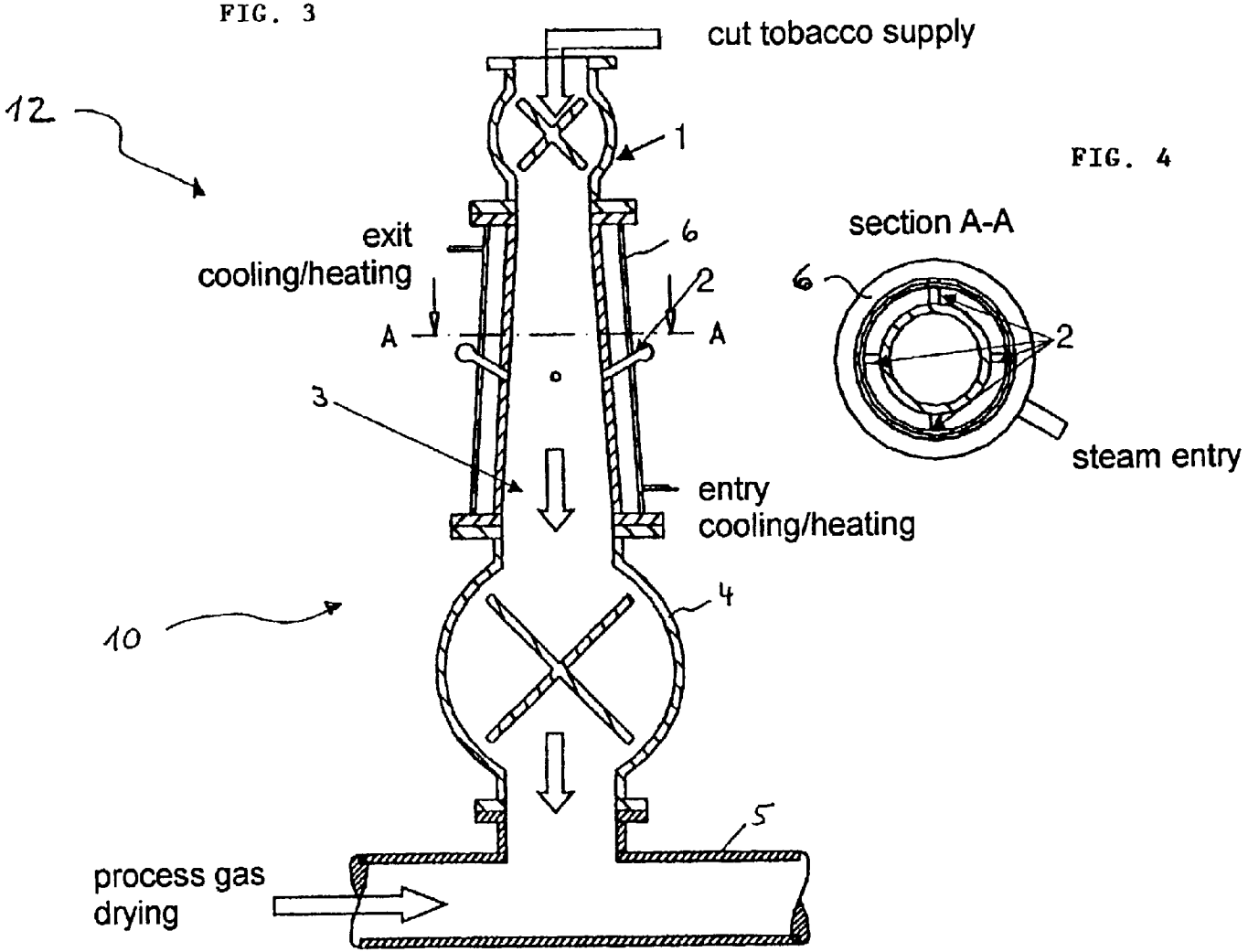
FIG. 3 is a vertical cross-section through a second embodiment of a device for (pre-) conditioning comminuted tobacco material.
FIG. 4 is a cross-section along the line A—A in FIG. 3.

To avoid water vapor condensing on the inside wall of the chamber 3, the chamber, formed as a pressure container, is provided with a heating jacket 6, as may be recognized in FIGS. 3 and 4. Vapor of a slightly higher temperature than the temperature of the vapor sprayed in via the ring nozzles 2 is fed into the bottom of the heating jacket, and drawn off, out of the heating jacket, at the top.

Once it has passed through the pre-conditioning under superatomospheric pressure and thus at extremely high temperatures, the pre-heated and moistened tobacco particles fall downwards through the lower cellular wheel sluice 4 into the airflow dryer 5, where they are swept along by the hot gas stream, and dried to the desired discharge or output moistness by the resting time in the dryer.

The drying of the tobacco is characterized in the first stage by the quick vaporization, up until the cooling limit temperature is reached; in this way, the vaporization energy is exclusively provided by the tobacco particles themselves.

In the second section, the tobacco is dried by convectional exchange of material and heat.

Figure 5:
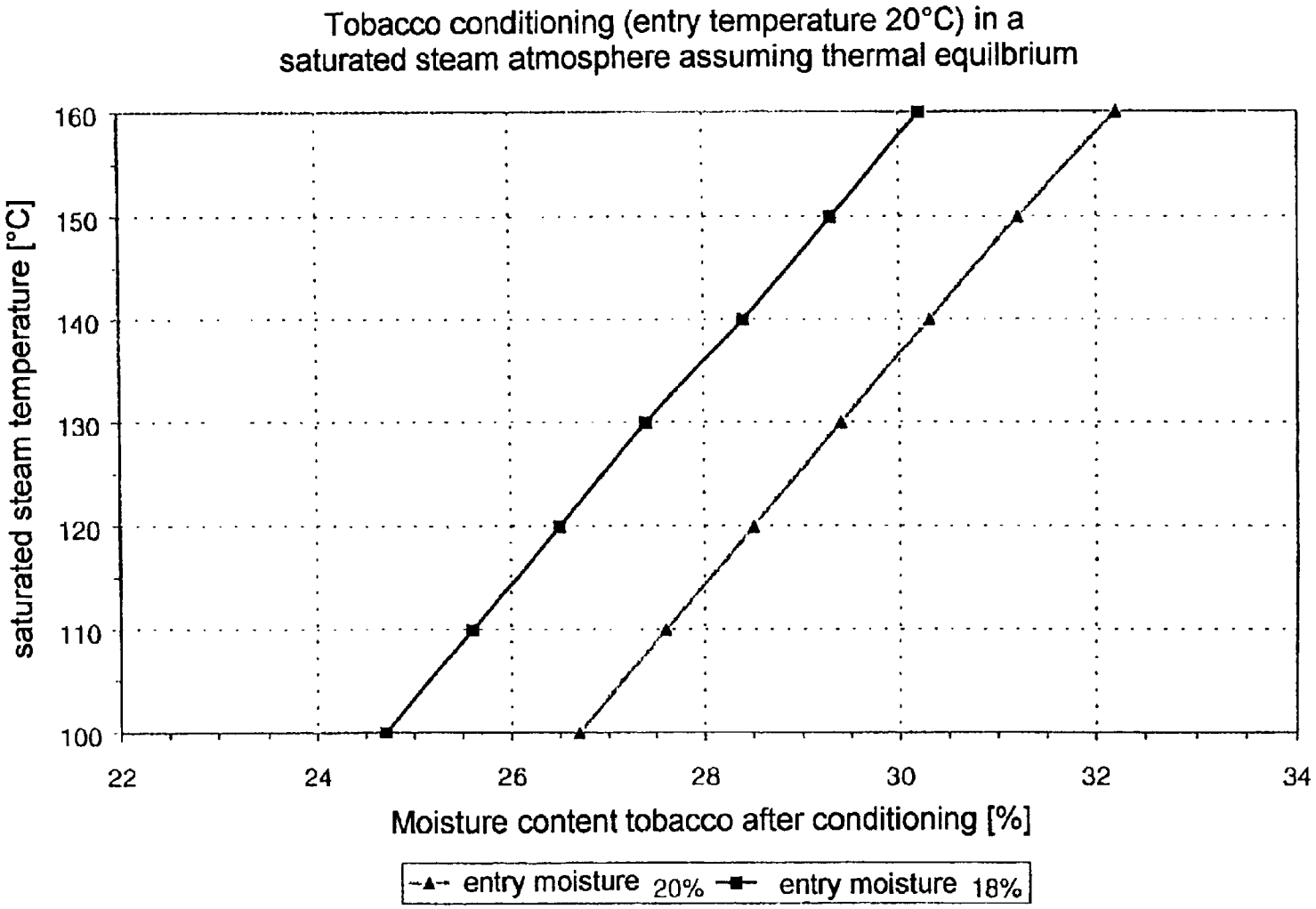
FIG. 5 is a diagram illustrating the course of the method.

FIG. 5 shows a diagrammatic representation of the conditioning of tobacco particles, which are introduced into a saturated vapor atmosphere in the pressurized chamber 3 at thermal equilibrium and with an entry temperature of 20° C.

In this respect, the line marked by triangles indicates the change in moisture content of the tobacco particles having an entry moistness of 20%, and the line marked by squares indicates the change in moisture content of the tobacco particles having an entry moistness of 18%.

As can be seen, the moisture content of tobacco particles after conditioning, expressed as a percentage, rises linearly in the range of saturated vapor temperature from 100° C. to 160° C., such that at a saturated vapor temperature of 160° C., for example, tobacco particles with an entry moistness of 18% leave the pre-conditioning device with a discharge moistness of about 30.25%.

The achievable increase in filling capacity will now be explained by means of an example which compares pressurized pre-conditioning using the device according to FIG. 3 for increasing tobacco temperature and moistness and subsequent airflow drying with pre-conditioning using water and vapor at normal air pressure.

Cut tobacco with a cut moistness after cutting of 18% was accordingly conveyed cold through a conditioning drum (without being conditioned) at a tobacco mass flow rate of 200 kg/h, relative to the cut moistness of 18%, and then driven at a vapor pressure of 5 bars through the device according to FIG. 3, which had been pre-heated using superheated vapor at 5 bars (>152° C.). In order to prevent moist cavities from forming, care must be taken that as little condensation as possible gets into the interior volume of the chamber 3.

The tobacco falling down the chamber 3 is brought up to the equilibrium temperature, which lies at about 152° C., by the absorption of condensing vapor. This results in moisture absorption of about 27% by mass. The falling time for covering a distance of about 1 m is only about 0.5 s.

The tobacco thus conditioned, i.e. heated and moistened, is dried in the airflow dryer 5 to a discharge moistness of about 13% by mass.

By way of comparison with this method course in accordance with the invention, cut tobacco containing 18% moisture was moistened to 27% in a conventional conditioning drum and at normal ambient pressure using vapor and water, pre-heated to about 60° C., and then conveyed at a rate of 200 kg/h through the device according to FIG. 3—without further conditioning—into the airflow dryer 5.

If the filling capacities of the tobacco from the two experiments are compared with each other at the outlet of the airflow dryer 5, the pressure-conditioned tobacco shows an increase in filling capacity of 5.9%, as compared with the comparative sample having passed through corresponding conditioning at ambient pressure in the conditioning drum.

The results for filling capacity were corrected to 12% by mass, in order to provide an exact comparability. Corresponding experiments were carried out in the device according to FIG. 3 at differing vapor pressures. The results obtained, expressed as percentage increases in filling capacity, are assembled in the following table, together with the accompanying process parameters.

As a comparative sample for the given pressure conditioning as described above, 18% moist cut tobacco and the corresponding tobacco moistness were conditioned to a tobacco temperature of 60° C. in a conditioning drum at ambient pressure using vapor and water, in order to ascertain the increase in a filling capacity.

| Pressure in device [bar] | moistness ex device [% by mass] | equilibrium temperature [° C.] | increase in filling capacity [%] |
|---|---|---|---|
| 2 | 24.1 | 120 | 3.1 |
| 3 | 24.9 | 134 | 3.9 |
| 4 | 26.2 | 144 | 4.5 |
| 5 | 26.5 | 152 | 5.9 |
| 6 | 27.0 | 159 | 6.6 |
| 7 | 27.4 | 165 | 7.1 |

As can be seen, the equilibrium temperature increases as expected with the pressure in the chamber, and in turn results in a corresponding proportional increase in filling capacity.

This series of experiments can, according to the quality of the cellular wheel sluices with respect to pressure and temperature, be continued in the direction of increasing pressures/temperatures. Correspondingly higher equilibrium temperatures and increases in filling capacity are then to be expected.

In the foregoing description preferred embodiments of the invention have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

What is claimed is:

1. A device for conditioning comminuted tobacco material by heating and moistening with water vapor, comprising:

a) a chamber, having an upper inlet and a lower outlet, in which said comminuted tobacco material free-falls downwards;

b) a cellular wheel sluice at each of the upper inlet and lower outlet of said chamber;

c) ring nozzles for treating said free-falling, comminuted tobacco material with water vapor; and d) a heating jacket; wherein:

e) both cellular wheel sluices are formed as pressure differential proof sluices, f) such that a hyperbaric pressure of more than 1 bar is maintained in said chamber.

2. The device as set forth in claim 1, wherein a discharge direction of said nozzles is inclined downwards.

3. The device as set forth in claim 1, wherein a discharge direction of said nozzles, seen in a horizontal plane, extends at an angle of about 90° to the circumferential direction of said chamber.

4. The device as set forth in claim 1, wherein said heating jacket is heated using vapor, said heating jacket in vapor communication with a steam source.

5. The device as set forth in claim 1, wherein said chamber expands in an approximately tapered manner downwardly.

6. The device as set forth in claim 1, wherein said lower cellular wheel sluice, formed as a discharge sluice, has a slightly higher conveying volume than said upper cellular wheel sluice, formed as a feed sluice.

7. The device as set forth in claim 1, wherein an airflow dryer is connected to said lower cellular wheel sluice.

8. A device for conditioning tobacco material, comprising:

a chamber having an inlet and an outlet;

a first wheel sluice at said inlet and a second wheel sluice at said outlet;

at least one water vapor nozzle located within said chamber;

a heating jacket;

said chamber maintaining a hyperbaric pressure of more than 1 bar.

9. The device for conditioning tobacco material of claim 8 wherein said chamber is aligned in vertical direction, said inlet of said chamber vertically above said outlet of said chamber.

10. The device for conditioning tobacco material of claim 9 wherein at least one water vapor nozzle is comprised of a plurality of water vapor nozzles within an interior surface of said chamber.

11. The device for conditioning tobacco material of claim 10 wherein said plurality of water vapor nozzles are directed downward.

12. The device for conditioning tobacco material of claim 9 wherein said tobacco material descends downward through said chamber from said inlet to said outlet.

13. The device for conditioning tobacco material of claim 12 wherein said first wheel sluice and said second wheel sluice are pressure differential sluices.

14. The device for conditioning tobacco material of claim 13 wherein said first wheel sluice has a first predetermined conveying volume and said second wheel sluice has a second predetermined volume, said first predetermined volume less than said second predetermined volume.

15. The device for conditioning tobacco material of claim 14 further comprising an airflow dryer in flow communication with said second wheel sluice.

16. A device for conditioning tobacco material, comprising:

a hyperbaric chamber having an inlet and an outlet;

a first pressure differential proof wheel sluice at said inlet of said hyperbaric chamber;

a second pressure differential proof wheel sluice at said outlet end of said hyperbaric chamber;

said second pressure differential proof wheel sluice having a larger conveying volume than said first pressure differential proof wheel sluice;

a plurality of nozzles within said chamber in flow communication with a vapor source;

a heating jacket surrounding said hyperbaric chamber;

wherein a hyperbaric pressure of more than 1 bar is maintained within said chamber.

17. The device for conditioning tobacco material of claim 16 wherein said vapor source is superheated vapor in vapor communication with said heating jacket and having a temperature between about 100° C. and 200° C.

18. A device for conditioning tobacco material, comprising:

a hyperbaric chamber having an upper inlet and a lower outlet and being tapered from said upper inlet to said lower outlet, said upper inlet having a pressure differential wheel sluice and said lower outlet having a pressure differential wheel sluice;

said hyperbaric chamber having at least one nozzle formed on an interior surface thereof in flow communication with a vapor source, said nozzle in flow communication with superheated vapor having a temperature between about 100° C. and 200° C.;

said hyperbaric chamber having a pressure of greater than 1 bar and having a heating jacket formed around an exterior surface, said heating jacket in vapor communication with said vapor source;

said pressure differential wheel sluice in said upper inlet having a lower conveying volume than said pressure differential wheel sluice in said lower outlet.

19. A device for conditioning tobacco material, comprising:

a hyperbaric chamber having an upper inlet and a lower outlet and being tapered from said upper inlet to said lower outlet, said upper inlet having a first pressure proof differential wheel sluice and said lower outlet having a second pressure proof differential wheel sluice;

said second wheel sluice having a larger conveying volume than said first wheel sluice;

a plurality of ring nozzles integrated with an interior surface of said hyperbaric chamber, each of said ring nozzles in flow communication with a superheated vapor source of at least 100° C.;

a heating jacket surrounding an exterior surface of said hyperbaric chamber, said heating jacket in flow communication with a heated vapor source;

wherein said hyperbaric chamber maintains an absolute pressure of about 2 to about 10 bars.

* * * * *